United States Patent [19]

Mortensen

[11] Patent Number: 4,940,237

[45] Date of Patent: Jul. 10, 1990

[54] GOLF SWING AID APPARATUS

[76] Inventor: Steven L. Mortensen, 6138 W. Poinsettia, Glendale, Ariz. 85304

[21] Appl. No.: 422,747

[22] Filed: Oct. 17, 1989

[51] Int. Cl.[5] ..... A63B 69/36

[52] U.S. Cl. ..... 273/189 R; 273/DIG. 30

[58] Field of Search ..... 273/189 R, 189 A, 190 R, 273/188 R, 188 A, 183 B, DIG. 30

[56] References Cited

U.S. PATENT DOCUMENTS

| | | | |
|---|---|---|---|
| 475,432 | 5/1892 | Blades | 273/189 R |
| 2,808,267 | 10/1957 | Heaton | 273/189 R |
| 3,069,169 | 12/1962 | Topping | 273/189 R |
| 4,061,340 | 12/1977 | Husted | 273/189 R |

*Primary Examiner*—George J. Marlo

*Attorney, Agent, or Firm*—H. Gordon Shields

[57] ABSTRACT

Golf swing aid apparatus includes a flexible length of elastic tubing adapted to be disposed about the upper torso of a user. A band is secured to the rubber tubing and is adapted to be disposed about and secured to the upper arm of a user. The flexible elastic tubing urges the upper arm and elbow of the user against the body during the backswing, and the follow through of the golf swing, while allowing arm extension during the backswing. The elastic tubing rolls over the user's torso during the back swing, the down swing, and the follow through to allow the user to make natural movements by not hindering the natural movements of the user. At the same time, the elastic tubing urges the upper arm and elbow against the user's body.

5 Claims, 1 Drawing Sheet

GOLF SWING AID APPARATUS

BACKGROUND OF THE INVENTION

1. Field of the Invention

This invention relates to apparatus for aiding a golfer's swing and, more particularly, to apparatus for aiding a golfer's swing for urging a golfer's upper arm and elbow against the golfer's body.

2. Description of the Prior Art

For a right-handed golfer, the upper arm and elbow of the right arm should remain fairly close to the body during the back swing, the down swing, and the follow through. When a golfer's arm, or upper arm and elbow, does not remain relatively close to the body, the back swing, the down swing, and the follow through are generally not consistent, and the result is not only poor technique, but also erratic hitting of the ball and consequent problems.

Over the years, various apparatus and methods have been suggested to aid a golfer in having the upper arm and elbow remain relatively close to the body during the back swing, the down swing, and the follow through. For example, at least one U.S. patent, U.S. Pat. No. 4,061,340 (Husted) discloses apparatus designed to help maintain the upper arm and elbow close to the body. The apparatus comprises a belt secured about the upper torso of the user and a band or strap secured to the belt and extending about the upper arm of the user. The band about the upper arm has an inside diameter substantially greater than the girth of the user's arm, so that limited movement of the arm is allowed. However, both the band and the belt are relatively inflexible, and accordingly remain in their relatively fixed positions as the user moves. The band may be moved on the belt, as desired, for the comfort or convenience of a user. However, again, the belt is relatively inflexible and so is the band, and accordingly the user's arm movements are limited.

The inflexibility of both the band and the belt provides limitations to the apparatus as far as the convenience of the user is concerned. The belt must be positioned at the desired location on the user's body and the user must hope that it remains in position and that it will not slip downwardly. Any downward movement would have an adverse effect on the band since the band is secured directly to the belt. Similarly, if the belt moves upwardly for some reason, the band would correspondingly move upwardly.

SUMMARY OF THE INVENTION

The invention described and claimed herein comprises flexible elastic tubing secured to a sleeve. The sleeve is adapted to be secured to the upper arm of a golfer, and the flexible elastic tubing is adapted to be disposed about the upper torso of the user. The elastic tubing is disposed about the sleeve, and thus about the arm, and inside the opposite arm of the user.

Among the objects of the present invention are the following:

To provide new and useful golf swing training aid apparatus;

To provide new and useful apparatus for aiding a golfer's swing;

To provide an elastic member adapted to be disposed about a golfer's arm and about the golfer's torso for urging the arm against the body during the back swing;

To provide new and useful apparatus for urging a golfer's arm close to the body while allowing extension of the arm during the back swing;

To provide new and useful apparatus for training a golfer to hold the upper arm and elbow of the trailing arm close to the body during the back swing, down swing, and follow through; and To provide new and useful apparatus having a flexible member movable on the torso as a golfer swings a golf club.

DESCRIPTION OF THE PREFERRED EMBODIMENT

Figure 1:
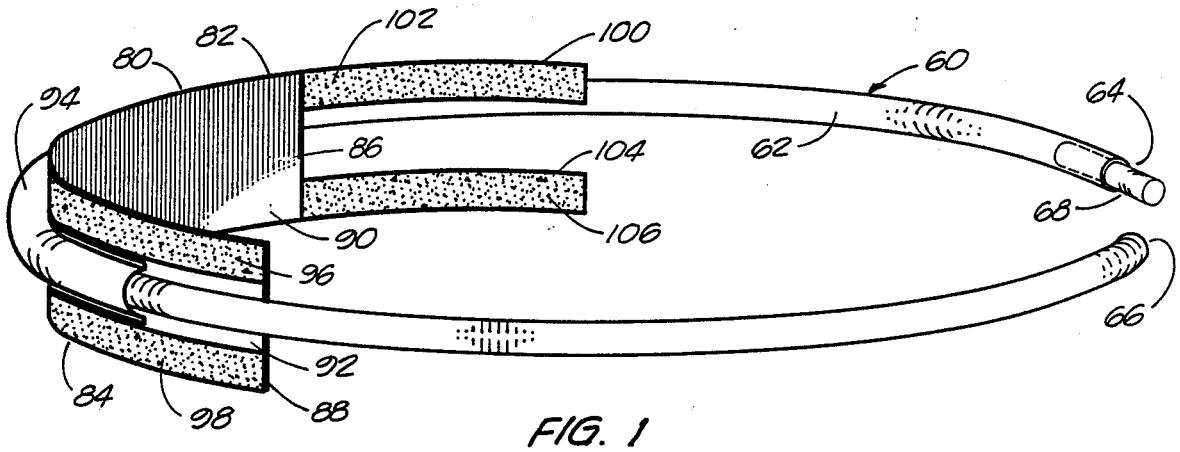
FIG. 1 is a perspective view of the apparatus of the present invention.

FIG. 1 is a perspective view of golf swing training aid apparatus 60 of the present invention. The apparatus 60 includes elastic tubing 62 and an arm band 80 secured to the tubing. The elastic tubing 62 includes a pair of ends, including an end 64 and an end 66. A connector 68 is used to secure the ends 64 and 66 together. As illustrated, a portion of the connector 68 extends into the end 64 of the tubing and is appropriately secured thereto, and another portion of the connector 68 extends into the end 66 and is appropriately secured therein. The tubing 62 is preferably rubber tubing of the type generally known, or referred to, as surgical rubber tubing.

The arm band 80 is a generally elongated rectangular panel having a top edge 82, a bottom edge 84, an end 86 and an end 88. The arm band is, of course, flexible and is adapted to be disposed about the user's arm, as illustrated in FIGS. 2, 3, 4, and 5.

The top and bottom edges 82 and 84 of the panel or element are generally parallel to each other, as are the ends 86 and 88.

Figure 3:
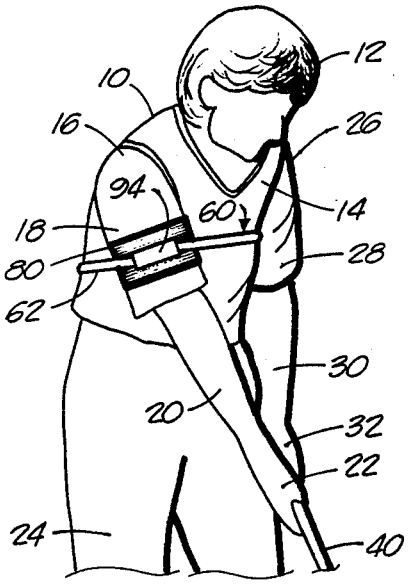
FIG. 3 is a perspective view of a golfer showing the apparatus of the present invention as the golfer addresses the ball.

The top and bottom edges 82 and 84 are relatively long edges, while the ends 86 and 88 are relatively short. The band 80 includes an inside surface 90 and an outside surface 92. Centered between the top edge 82 and the bottom edge 84, and appropriately secured to the outside surface 92 of the arm band 80 is a tubular element or sleeve 94. The tubular element or sleeve 94 is appropriately secured to the outer surface 92 about midway between the top edge 82 and the bottom edge 84 and extends for a relatively short distance on the band 80, as best shown in FIG. 3.

The elastic tubing 62 extends through the tubular element or sleeve 94. After the tubing 62 has been disposed in the sleeve 94, and thus is secured to the arm band 80, the ends 64 and 66 are appropriately secured together to the connector 68.

The arm band 80 also includes a pair of fastening surfaces or portions, including an upper fastening surface or portion 96 and a lower fastening surface or portion 98. The fastening surfaces 96 and 98 extend along the outside portion or surface 92 of the band 80 from the edge or end 88 of the sleeve. They extend for a distance sufficient to enable the band 80 to be secured to persons having different sized upper arms.

A pair of fastening straps 100 and 104 extend outwardly from the edge 86 of the band 80. The fastening strip 100 is an upper or top fastening strip, and the fastening strip 104 is a lower or bottom fastening strip. The fastening strips 100 and 104 include fastening surfaces which cooperate with the fastening surfaces or portions 96 and 98.

The upper fastening strip 100 includes an inside fastening surface or portion 102 which cooperates with the fastening surface or portion 96. The lower or bottom strip 104 includes an inside fastening surface or portion 106 which cooperates with the fastening surface or portion 98. The respective fastening surfaces or portions include the well known hook and loop type fastening elements, with the loop elements on one cooperating portion and the hook elements on the other cooperation portion to secure the arm band to the upper arm of the individual user of the apparatus.

As is best shown in FIG. 1, the sleeve 94 terminates well before the edge 88 of the band 80. Accordingly, for a user having a relatively small arm, the end 86 of the band 80 may overlap the end 88, if necessary. The fastening surfaces 96 and 98 extend a sufficient distance along the exterior surface 92 of the band 80 to allow contact with the fastening surfaces 102 and 106 of the fastening strips 100 and 104, respectively, to adequately secure the arm band 80 to a user regardless of the girth of the upper arm of the user.

Figure 2:
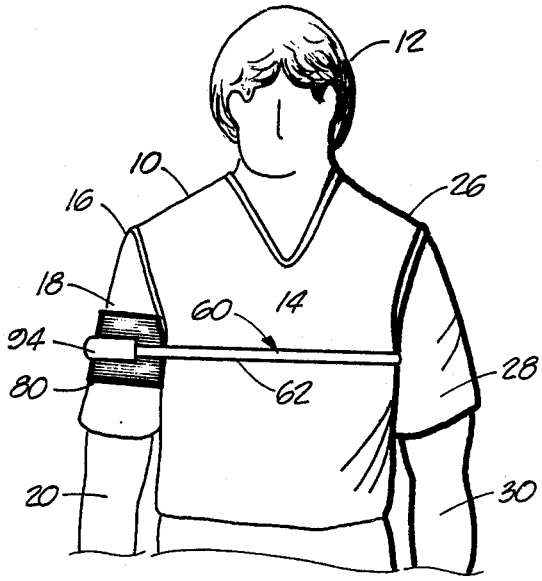
FIG. 2 is a front view of a golfer with the apparatus of the present invention secured to the golfer.
Figure 4:
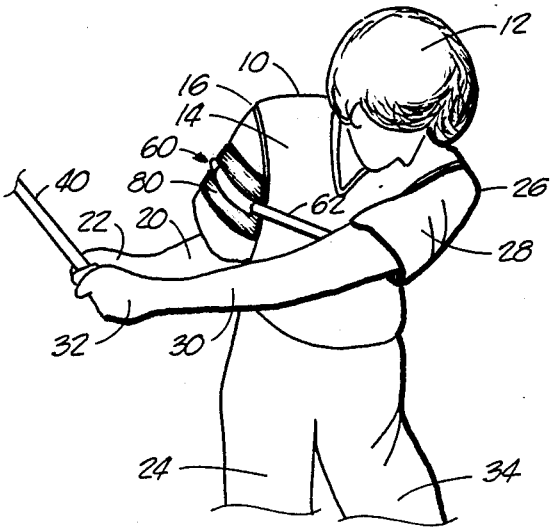
FIG. 4 is a perspective view sequentially following FIG. 3, with the user of the apparatus of the present invention in both a back swing and a down swing position.
Figure 5:
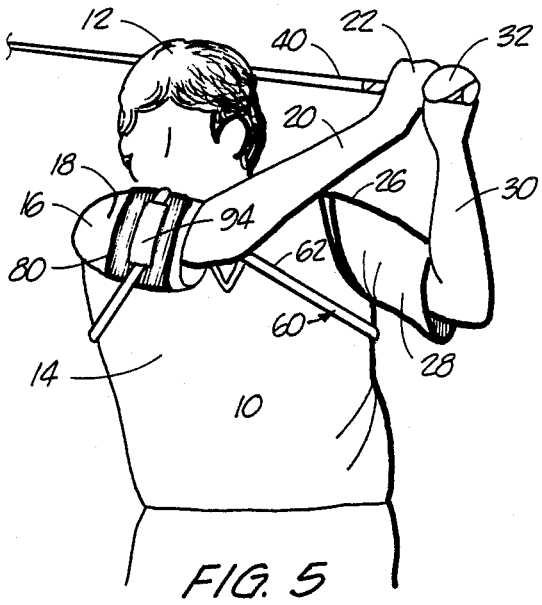
FIG. 5 is a front view sequentially following FIG. 4 illustrating the apparatus of the present invention at the end of the follow through of a golf swing.

FIGS. 2, 3, 4, and 5 illustrate the use of the apparatus 60. The apparatus 60 is shown in FIGS. 2, 3, 4, and 5 secured to a user 10. FIG. 2 illustrates the apparatus 60 secured to the user 10, and FIGS. 3, 4, and 5 are sequential views illustrating the operation of the apparatus 60 as the user swings a golf club.

In FIGS. 3, 4, and 5, the user 10 is shown with the apparatus 60 as the user sequentially addresses the ball, as in FIG. 3, and swings as in FIG. 4, and follows through, as in FIG. 5. FIG. 4 illustrates both a partial back swing, and a partial down swing, while FIG. 5 illustrates only the last portion of the follow through.

For purposes of illustrating the use and operation of the apparatus 60, the user illustrated in FIGS. 2, 3, 4, and 5 includes a head 12 extending upwardly from an upper torso 14. The user also has a right shoulder 16, a right upper arm 18, a right forearm 20, a right hand 22, and a right leg 24. The user also includes a left shoulder 26, a left upper arm 18, a left forearm 30, a left hand 32, and a left leg 34. The upper part of the shaft of a golf club 40 is shown held in the hands 22 and 32 of the user 10 in FIGS. 3, 4, and 5.

In FIG. 3, the user is addressing the ball, and the apparatus 60 is shown with the band 80 disposed about the upper arm 18 and with the tubing 62 extending about the upper arm 18 and about the torso 14.

In FIG. 4, the user 10 is beginning the back swing. The apparatus 60 is urging the right upper arm 18, and the right elbow, against the body or torso 14. However, the elasticity of the tubing 62 allows the necessary extension of the upper arm 18 without actually limiting arm movement. Thus, the tubing 62 urges the upper arm 18, and consequently also the elbow, of the user 10 against the body by providing a bias which inherently increases as the band 62 stretches. However, the elasticity of the band 62 does not limit any arm and elbow movement.

FIG. 4, as previously indicated, also represents a portion of the down swing. Again, the apparatus 60, under the bias of the tubing 62, urges the upper arm and elbow against the body or torso 14 of the user during the swing.

FIG. 5 illustrates the end of the follow through of the golf swing. It will be noted that the apparatus 60, while providing a bias to urge the upper arm 18, and elbow, against the torso 14, nevertheless allows the tubing 62 to move on the torso 14 during the golf swing. Since the tubing is round, and is elastic or flexible, it not only expands, as required during the swing, but it also rolls over the torso as the user swings. That is, the tubing moves by rolling upwardly and downwardly, as appropriate, during the swinging of the golf club 40 by the user 10. The tubing 62 moves in what may be called or referred to as a "normal" manner as the body and arms move and shift during the backswing, the downswing, and the follow through. However, all during the movement of the body and arms, the tubing 62, through the band 18, urges the upper arm 18 and the elbow against the upper body or torso 14.

It will be appreciated that the elasticity of the member 62 allows it not only to expand, but, as is well known and understood with such elastic members, the tension of the tubing member 62 increases the farther away from the "normal" or rest position, as illustrated in FIG. 2, the tubing is stretched. That is, as the user reaches the top of the back swing, and the top of the follow through, the tubing 62 is stretched to its maximum length during the swing, and accordingly the tubing exerts its maximum bias to urge the arm 18 against the torso 14 at the top of the backswing and the follow through.

While the tubing 62 stretches and biases the upper arm 18 against the torso or upper body portion 14, the tubing also rolls on the body. Referring again to FIG. 1, it will be seen that the connector 68 is generally of a round and cylindrical configuration. the tubing 62 has a generally circular or round cross-sectional configuration to allow or permit it to roll easily over the torso or upper body portion 14.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Golf swing training apparatus for a golfer having a torso and an upper arm, comprising, in combination:

band means securable to the golfer's upper arm; and elastic means secured to the band means and adapted to be disposed about the golfer's torso for urging the golfer's upper arm against the torso as the golfer swings said elastic means having a generally circular cross sectional configuration to allow the elastic means to roll over the golfer's torso during the golfer's swing.

2. The apparatus of claim 1 in which the band means includes a band disposed about the golfer's upper arm and means for securing the elastic means to the band.

3. The apparatus of claim 2 in which the means for securing the elastic means to the band includes a sleeve secured to the band and the elastic means extends through the sleeve.

4. The apparatus of claim 3 in which the band comprises a flexible panel having an inside surface and an outside surface, and the sleeve is secured to the outside surface.

5. The apparatus of claim 1 in which the elastic means comprises a length of flexible tubing.

* * * * *